US006749168B2

(12) United States Patent
Johnson

(10) Patent No.: US 6,749,168 B2
(45) Date of Patent: Jun. 15, 2004

(54) MERCHANDISING SYSTEM

(75) Inventor: Allen E. Johnson, Hartford, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 10/154,492

(22) Filed: May 22, 2002

(65) Prior Publication Data

US 2002/0174581 A1 Nov. 28, 2002

Related U.S. Application Data

(60) Provisional application No. 60/293,351, filed on May 22, 2001.

(51) Int. Cl.[7] ..... A47B 95/00
(52) U.S. Cl. ..... 248/349.1
(58) Field of Search ..... 248/349.1, 652, 248/664, 346.05, 131; 104/44, 45, 36, 38, 35, 46

(56) References Cited

U.S. PATENT DOCUMENTS 1,378,898 A * 5/1921 Potts ..... 104/36
1,699,463 A * 1/1929 Cresci ..... 108/20
2,025,320 A * 12/1935 Waalkes ..... 104/44
3,580,191 A * 5/1971 McDonnell ..... 108/152
3,891,171 A * 6/1975 Samuelian et al. ..... 248/131
4,020,767 A * 5/1977 Hardy ..... 104/35
4,498,398 A * 2/1985 Vallee ..... 104/44
4,750,428 A * 6/1988 Hyte et al. ..... 104/40
4,753,173 A * 6/1988 James ..... 104/45
5,086,704 A * 2/1992 Mueller ..... 104/44
5,582,112 A * 12/1996 Huang ..... 108/22
5,626,079 A * 5/1997 Summers ..... 104/44
5,852,978 A * 12/1998 Daschel ..... 104/44
6,467,746 B1 * 10/2002 Paskiewicz ..... 248/349.1
6,470,807 B2 * 10/2002 Warner ..... 104/35

* cited by examiner

*Primary Examiner*—Leslie A. Braun
*Assistant Examiner*—A. Joseph Wujciak
(74) *Attorney, Agent, or Firm*—Foley & Lardner LLP

(57) ABSTRACT

A merchandising and/or display system for displaying objects is disclosed. The display system for differently sized vehicles comprises a base, a first plate configured to be rotated relative to the base, members coupled to the first plate, a mounting plate comprising a number of slots and coupled to the members, and supports configured to be coupled to the mounting plate at locations along the slots. The supports are configured to be adjustable to accommodate differently sized vehicles.

16 Claims, 10 Drawing Sheets

MERCHANDISING SYSTEM

CROSS-REFERENCE TO RELATED PATENT APPLICATIONS

The present application claims the benefit of U.S. Provisional Patent Application No. 60/293,351 ("DISPLAY SYSTEM") filed May 22, 2001 under 35 U.S.C. §119, incorporated in the present application by reference.

FIELD OF THE INVENTION

The present inventions relate to merchandising systems. The present inventions more specifically relate to a merchandising system providing for support and display of a vehicle or the like.

BACKGROUND OF THE INVENTION

It is known to provide for a merchandising system that may be used for vehicles and the like. Such known merchandising systems do not realize certain advantageous features (and/or combinations of features).

It would be advantageous to provide a merchandising system for an object (such as vehicle, motorcycle, etc.) of a type disclosed in the present application that may be easily adjustable and reconfigurable for a variety of different sized and shaped objects. It would further be advantageous to provide a merchandising system which may be easily adapted to support a variety of different sized and shaped products. It would further be advantageous to provide a merchandising system that provides a universal interface (or mount) for various products (including vehicles such as motorcycles) having a variety of mounting structures such as frames. It would further be advantageous to provide a merchandising system that may be used on a variety of moveable and non-moveable bases. It would further be advantageous to provide a merchandising system that provides selective adjustability for various products (e.g. a single interface may accommodate a variety of different products and/or frames having different mounting points).

It would be desirable to provide a merchandising that provides any one or more of these or other advantageous features.

SUMMARY OF THE INVENTION

The present invention relates to a merchandising system for displaying objects. The objects have mounting points at different locations. The merchandising system comprises a base, an interface coupled to the base, and at least one support coupled to the interface. The at least one support is configured to be coupled to the interface at a first position to provide a first mounting arrangement and is configured to be coupled to the interface at a second position to provide a second mounting arrangement.

The present invention also relates to a merchandising system for differently sized vehicles. The display system comprises a base, a first plate configured to be rotated relative to the base, members coupled to the first plate, a mounting plate coupled to the members, and supports configured to be coupled to the mounting plate. The supports are configured to be adjustable to accommodate differently sized vehicles.

The present invention further relates to a merchandising system for an object having a frame. The merchandising system comprises a plate, a number of apertures provided in the plate, a support configured to be received in one aperture and configured to couple with the plate. The support couples with the frame of the object, and the support is configured to be adjusted relative to the plate to accommodate objects of different size.

DETAILED DESCRIPTION OF THE PREFERRED EMBODIMENTS

Figure 1:
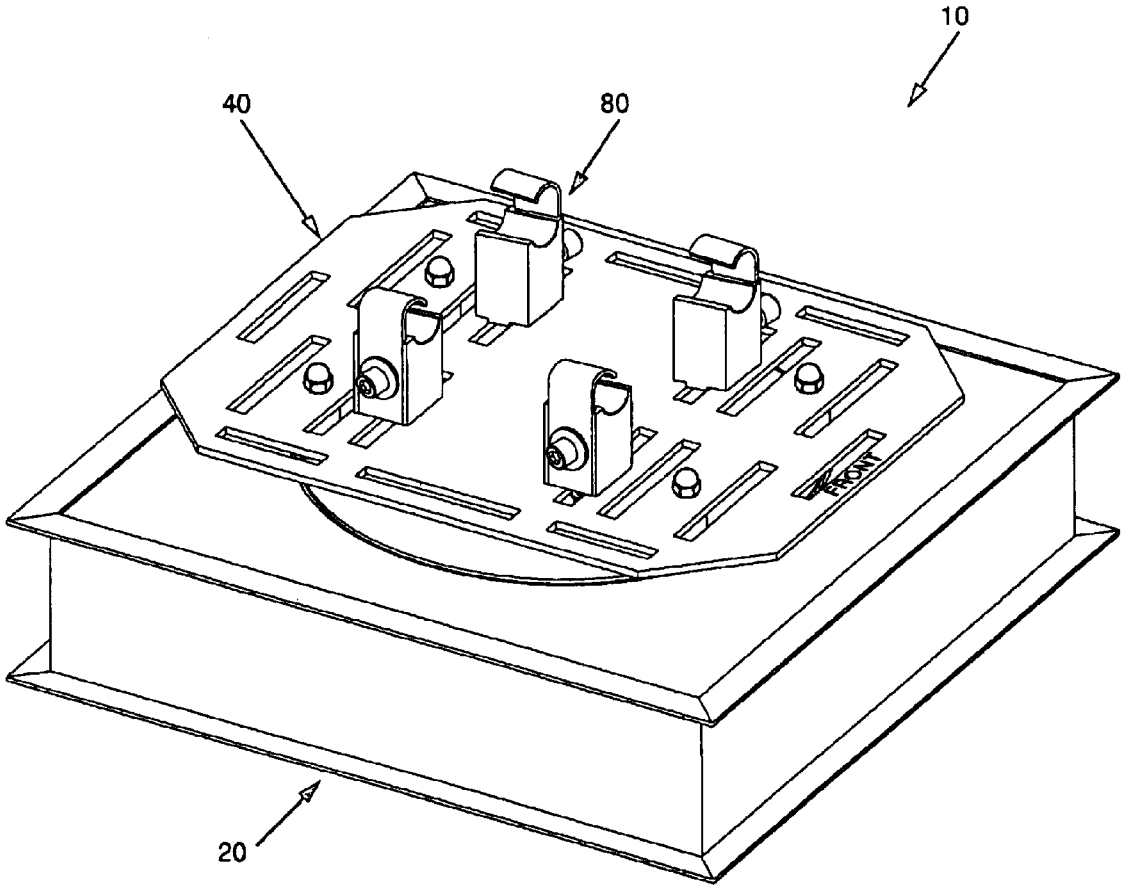
FIG. 1 is a perspective view of a merchandising system according to one exemplary embodiment.

Referring to the FIGURES, exemplary embodiments of a merchandising system are shown. The merchandising system may provide for the display and presentation of a wide variety of articles or objects such as vehicles, motorcycles, automobiles, snowmobiles, all-terrain vehicles, products, etc. The merchandising system may be used in environments such as display rooms, show rooms, etc.

As shown in the FIGURES, the merchandising system advantageously allows differently sized objects to be displayed on a single merchandising system. A single merchandising system may be reconfigured to accommodate a number of different sizes, shapes and configurations of objects while not requiring significant time or effort for accomplishing the reconfiguration. The merchandising systems shown are intended to provide a single system which may accommodate variously sized objects. According to a particularly preferred embodiment the object is a motorcycle.

Referring to FIGS. 1 through 8, one exemplary embodiment of a merchandising system 10 is shown. Merchandising system 10 may comprise a base 20, an interface 40, one or more members 60 and one or more supports 80.

Base 20 (which may be a platform, stand, etc.) may generally comprise a housing 22, a motor 26, and lights 28.

Figure 2:
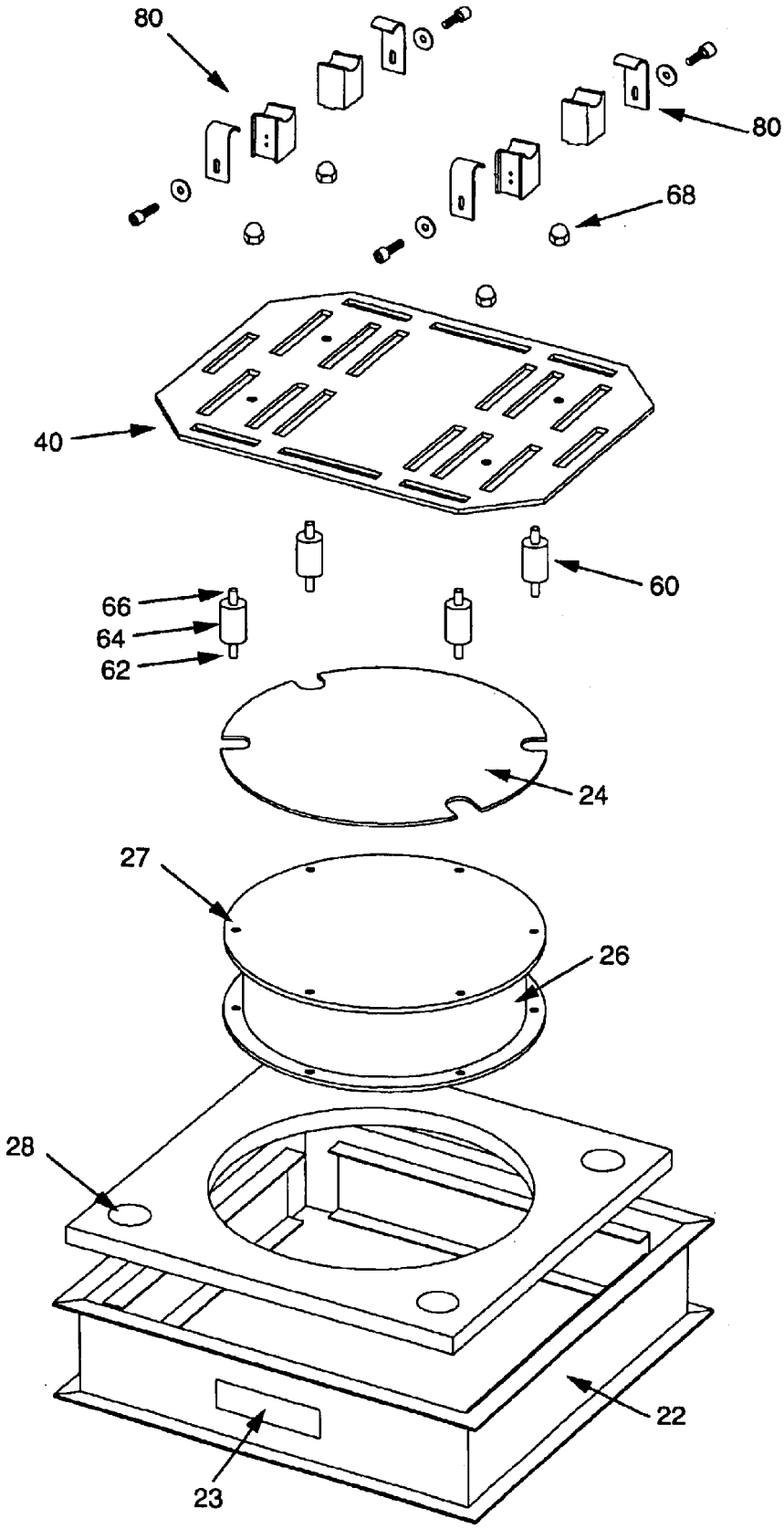
FIG. 2 is an exploded perspective view of the merchandising system shown in FIG. 1.

Housing 22 of base 20 generally defines the outer perimeter of base 20. As shown in FIG. 2, housing 22 may be a generally square shape. According to alternative embodiments the housing may be any desired shape, such as rectangular, circular, triangular, etc, or combinations of various shapes. Housing 22 may have indicia 23 (e.g. lettering, graphics, text, etc.) disposed on various surfaces or edges of housing 22. Housing 22 may be provided with a variety of other surface treatments, texturing, lettering, designs, artwork, etc.

In an effort to enhance visual appeal of the object, the merchandising system may move (e.g. rotate, etc.) the object relative to the base. According to one exemplary embodiment shown in FIG. 8, the object rotates around a central axis Y—Y of base 20. (The rotation or movement of the object may add to the visual appeal of the object by allowing the object to be observed more fully and conveniently.)

Figure 9:
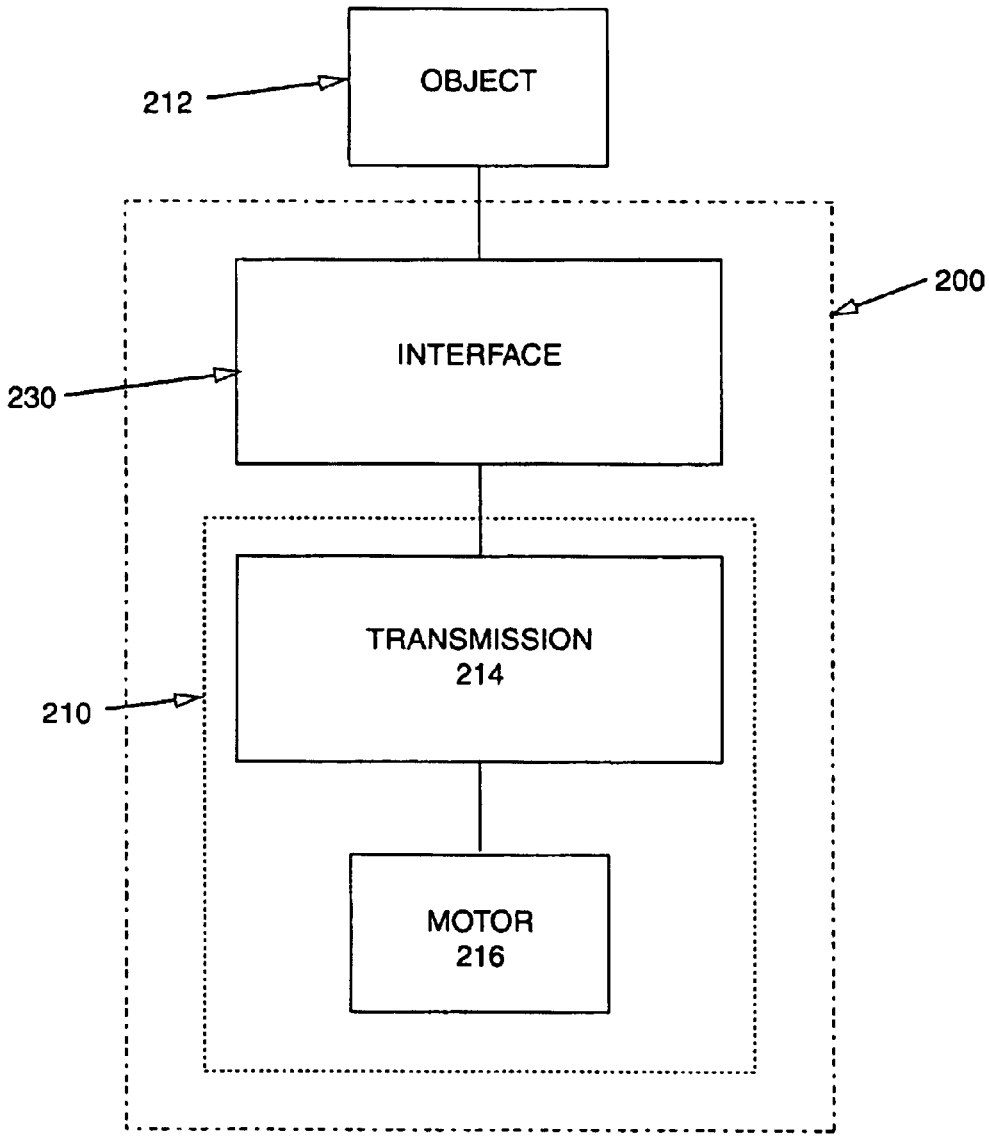
FIG. 9 is a schematic view of a merchandising system.

To provide rotation (or movement), motor 26 may be provided in base 20 of merchandising system 10. Motor 26 may be coupled to housing 22 with a variety of fasteners (not shown) including mechanical fasteners, screws, bolts, adhesives, etc. Motor 26 allows for the powered movement or rotation of the object. According to a particularly preferred embodiment, the motor may be commercially available under the name "Turn-Plate," (Model No. U 5000) from Outwater Plastic Industries, of Wood-Ridge, N.J. According to alternative embodiments, the motor may be of any conventional type of motor capable of rotating the object. The merchandising system may use a "direct drive" (i.e. the motor may be have a "direct" drive link or coupling with the object, e.g. by a rigid connection between the motor and the interface/object). According to alternative embodiments, the merchandising system may use an "indirect drive" (i.e. the motor may be coupled to the object via other drive assemblies such as belts, gear trains, transmissions, piston/rocker or cam/eccentric action etc.) that may allow for adjustment and/or adaptation of movement (e.g. linear or eccentric or rotation or some combination) for a particular application. For example, as shown in FIG. 9, a merchandising system 200 for the display of an object 212 may include a drive system (shown as drive assembly 210). Drive assembly 210 may be provided to rotate object 212. Drive assembly 210 may include a transmission 214, and a motor 216. Interface 230 may be coupled to drive assembly 210 in order to attach or couple object 212 to merchandising system 200. The use of a suitable drive assembly or drive system may allow for the use of lower power motors, providing variable rotation speed of the displayed product, translating or providing linear movement of the object, etc. Plate 24 (shown as a cover plate in FIG. 2) may be provided on the top of motor 26.

In an effort to further enhance the visual or aesthetic appeal of the object (or objects) upon merchandising system 10, base 20 may be provided with various lights or lighting effects (shown as lights 28). Such lighting effects may be used to illuminate or feature the object or to illuminate various features of the object.

As shown in FIG. 2, members 60 (which may be stands, supports, posts, etc.) may be coupled to base 20. According to a particularly preferred embodiment, members 60 are coupled to motor 26. Members 60 separate interface 40 from base 20. Members 60 may couple with motor 26 via a shaft portion 62 configured to be received in apertures 27 provided at motor 26. According to alternative embodiments, members 60 may couple with motor 26 with fasteners such as bolts, threaded shafts, screws, rivets, welding, etc. According to an alternative embodiment, the members may be omitted, and other suitable mounting arrangements may be provided for rotation of the object.

According to a particularly preferred embodiment (shown in FIG. 2) members 60 are of sufficient height as to allow interface 40 to rotate above base 20 to allow the object to be raised (or suspended) above the floor to freely rotate off the floor (e.g., without interference) and/or to clear base 20 (and associated fixtures or the like). In one exemplary embodiment, where the object is a motorcycle, the height of base 20 and members 60 is such that when the motorcycle is mounted on merchandising system 10, neither of the wheels of the motorcycle are not in contact with the floor.

As shown in FIG. 2, merchandising system 10 further includes an interface 40. The interface may be a mounting structure, such as a fixture, plate, member, web or other frame of a suitable strength and/or rigidity to support the object (or objects) etc. As shown in FIG. 2, interface 40 may be attached to members 60 using a variety of different fasteners (shown as cap nuts 68).

Figure 3:
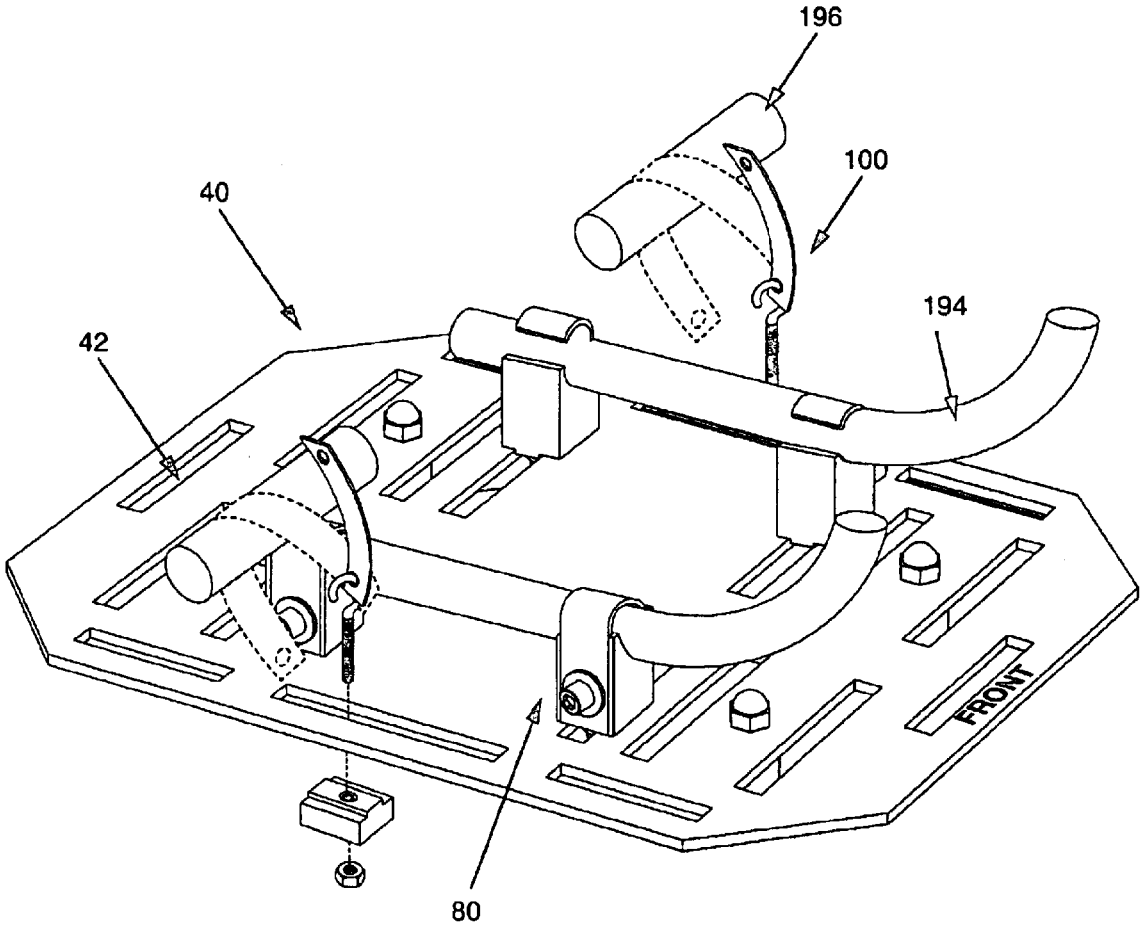
FIG. 3 is a partial exploded view of an interface for use with the merchandising system shown in FIG. 1.
Figure 4:
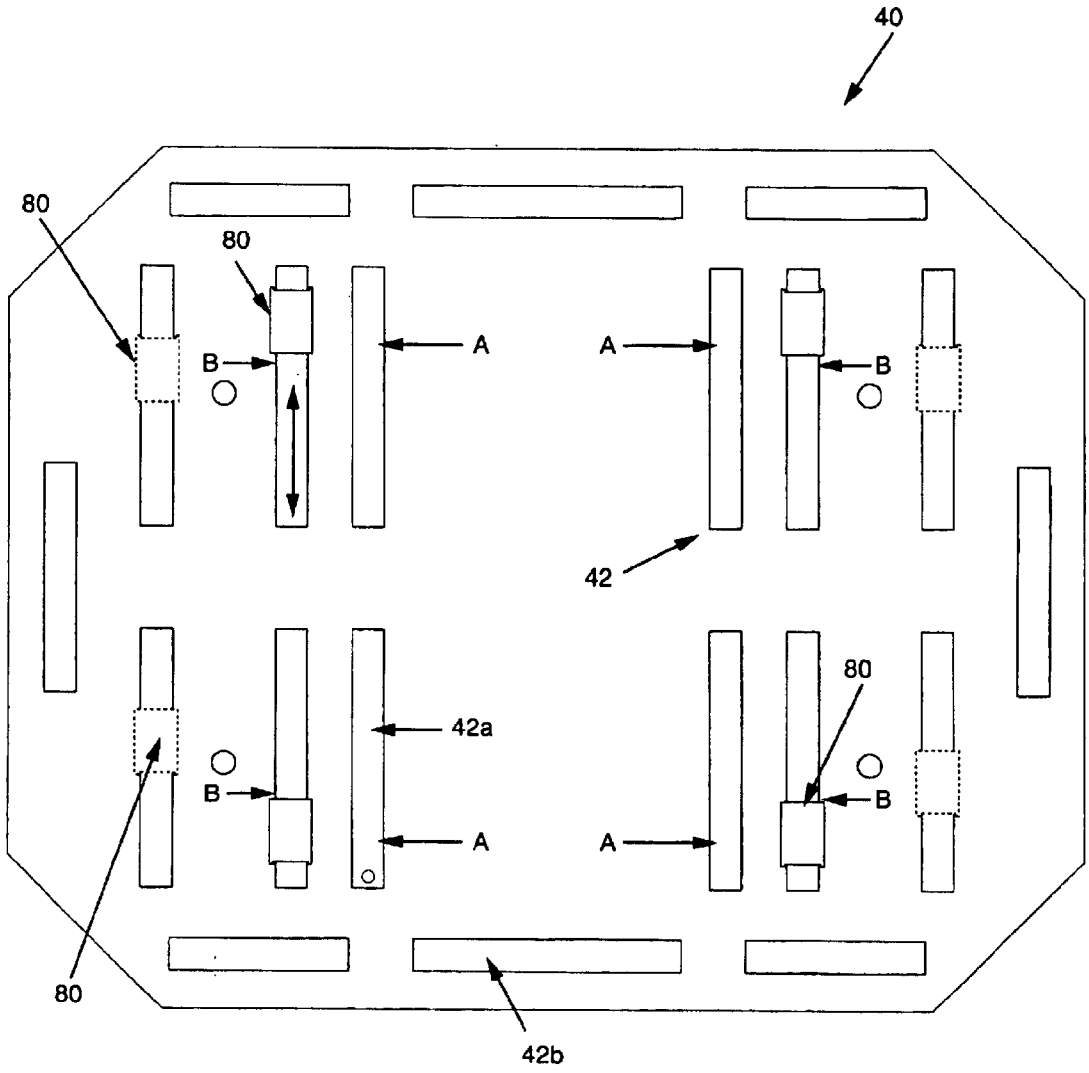
FIG. 4 is a top view of the interface showing two adjustment positions.
Figure 5:
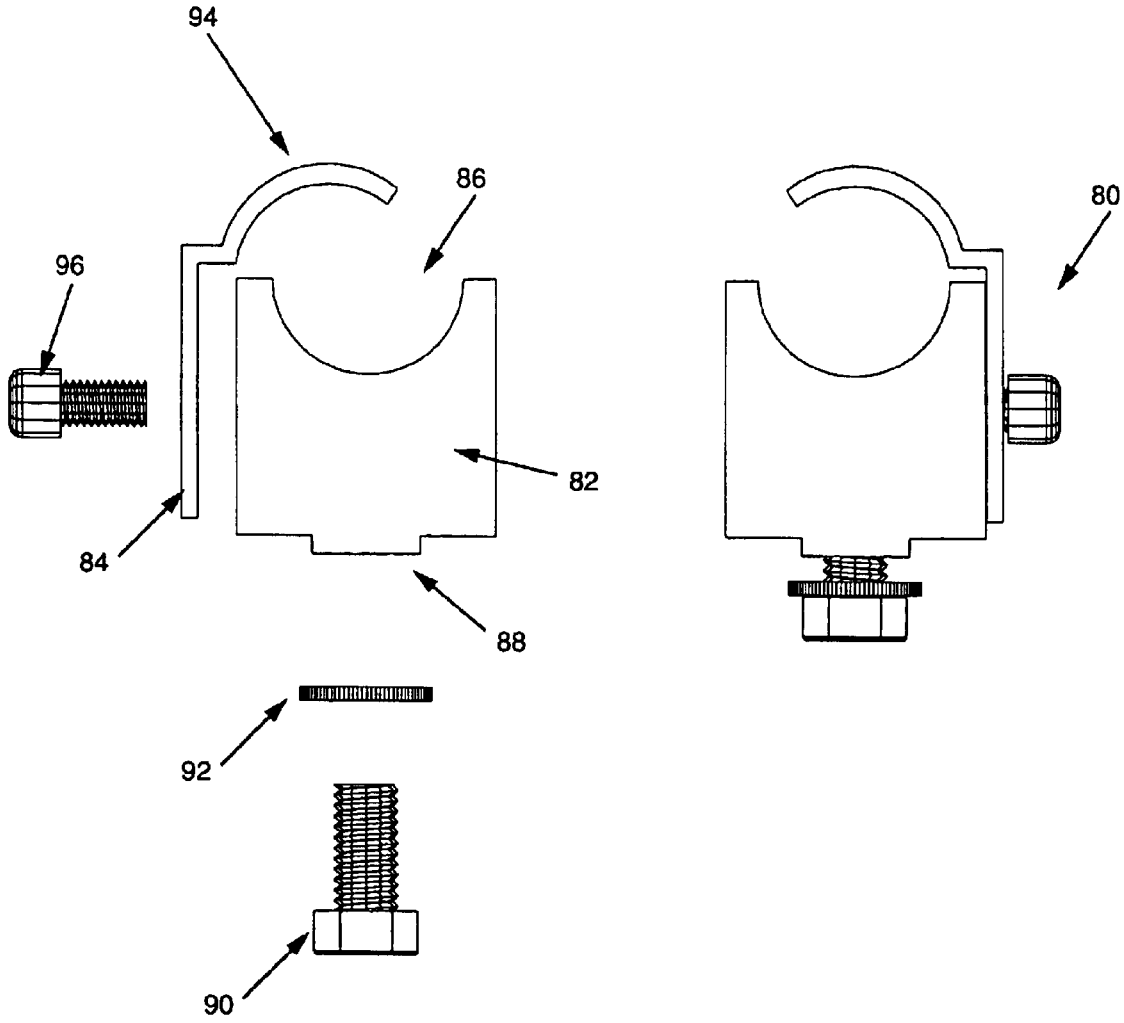
FIG. 5 are exploded elevation views of a support for use with the merchandising system shown in FIG. 1.
Figure 6:
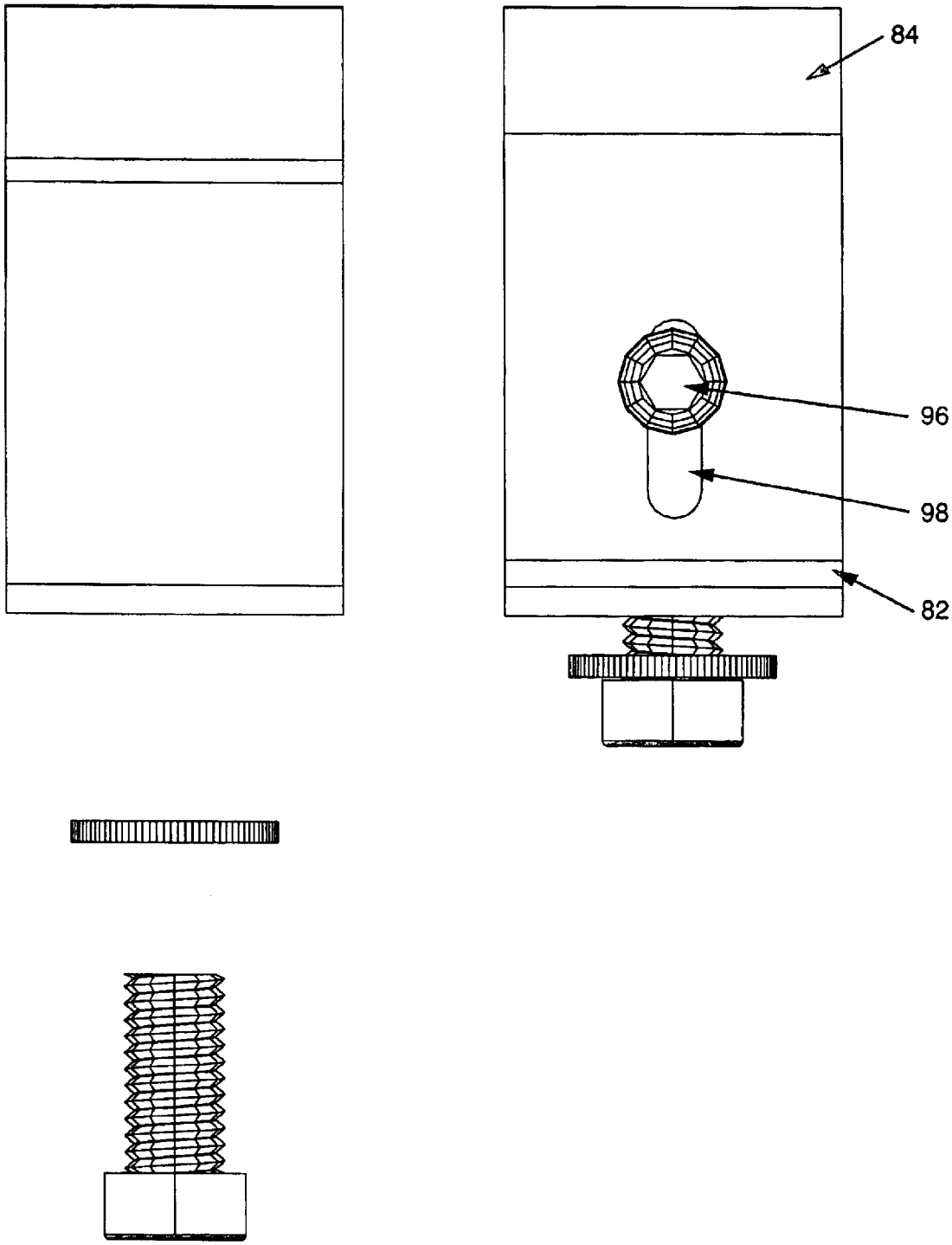
FIG. 6 are side elevation views of the support shown in FIG. 5.
Figure 7:
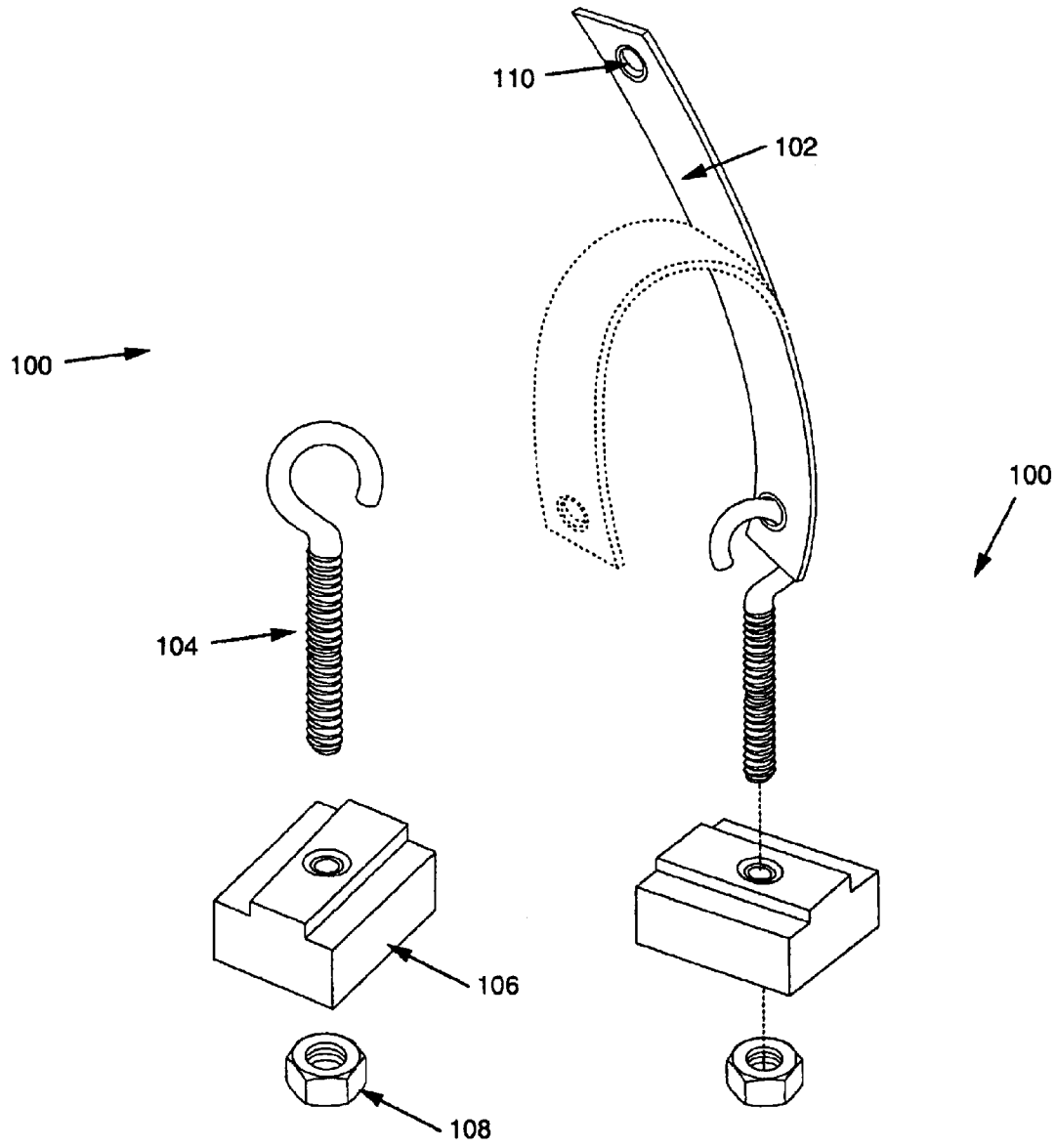
FIG. 7 is an exploded perspective view of the connector shown in FIG. 1.
Figure 10:
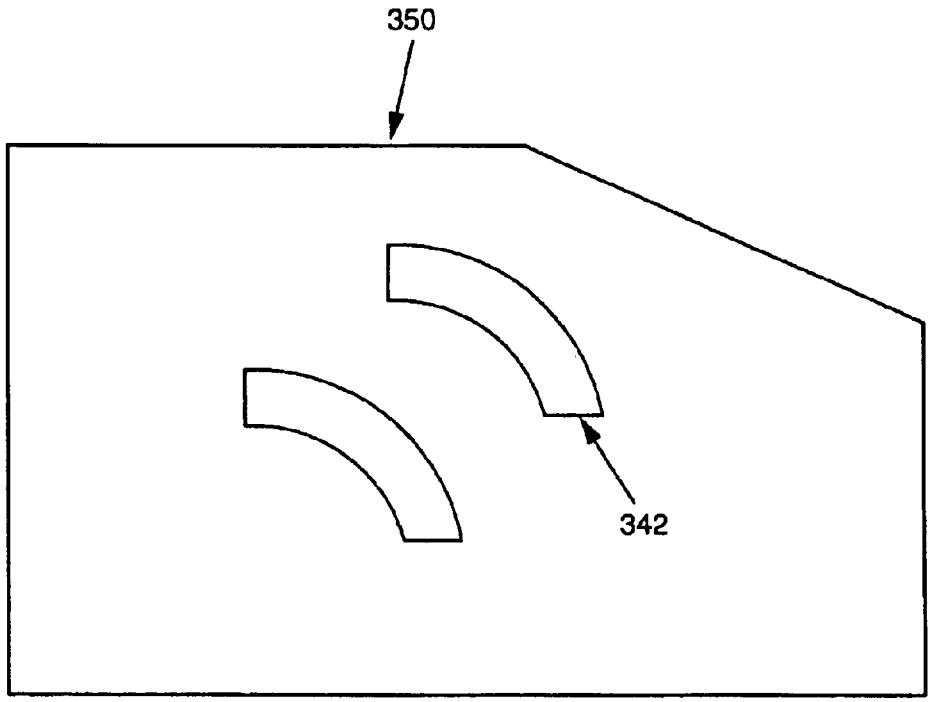
FIG. 10 is a partial top plan view of an interface according to an alternative embodiment.

As shown in FIGS. 3 and 4, interface 40 may be provided with a plurality of apertures shown as slots 42. According to any preferred embodiment, the interface is intended to provide a "universal" interface capable of being configured to couple to any of a variety of objects that may have different shapes, sizes, weights, and/or mounting points for display upon the merchandising system. Slots 42 may be provided on interface 40 in a variety of directions, locations and orientations. According to a particularly preferred embodiment shown in FIG. 4, slots 42 may be provided in a quantity and orientation as to allow for the display of variety of objects with different sizes and/or mounting points. Slots 42 provide flexibility in the orientation and placement of supports 80. Slots 42 may be provided with an appropriate profile for coaction with the supports and/or for the mounting of the objects (or category of objects). For example, slots 42 may be provide with a linear, curved (e.g., see slot 342 provided on interface 350 in FIG. 10), parallel, perpendicular or other shape, pattern or profile. According to a particularly preferred embodiment, slots 42 may provide convenient mounting points for at least four motorcycle frame configurations. According to other alternative embodiments, the apertures or slots may be provided in various other number and/or arrangements as to provide convenient mounting options or points for one or more or any of a wide variety of objects and/or categories of objects (e.g., that may provide numerous other frame configurations and/or mounting options or points). According to any preferred embodiment, the interface will provide for the "universal" or selective engagement (e.g., with slots or projections by coaction with supports (e.g., with projections or slots) that couple to the object (or objects) as is suitable for display within the merchandising system.

Interface 40 may provide a selectively adaptable and/or reconfigurable interface between a variety of objects (such as a displayed products, vehicles, motorcycles, etc.) and base 20. According to alternative embodiments, the interface may be mounted to a variety of different structures, including rotating, non-rotating, moveable, and non-moveable bases.

Merchandising system 10 may further comprise supports 80 (which may be posts, frame brackets, frame clamps, support structures, etc.). Supports 80 (shown in FIGS. 5 and 6) may include a base (or riser) shown as base 82 and a clamp (or clamp portion) shown as member 84. Supports 80 may be a clamp (such as an adjustable clamp). Supports 80 couple or otherwise interface with interface 80.

Base 82 may be a structural support member. Base 82 may include a surface 86 configured to fit or support a structural member of the object (e.g. a frame, or other suitable support structure). (See frame member 194 in FIG. 3.) According to one exemplary embodiment, surface 86 is a curved or semi-circular surface configured to support a frame of a motorcycle. According to alternative embodiments, the surface may have a wide variety of shapes configured to coact with the object including flat, angular, oblong, etc. Surface 86 may further be provided with a cushioning or resilient piece of material such as rubber or the like (not shown) to prevent damage to the frame. Base 82 may be further configured to have a bottom portion (shown as tongue 88) which is configured to fit into slots 42 of interface 40. Base 82 may move along a slot into a suitable position as required by the shape or configuration of the object. Once in a suitable position, base 82 may then be secured to the plate using fasteners (shown as bolt 90 and washer 92). Once secured relative to interface 40, the object may then be positioned on the bases 82. The positions and configuration of the bases is such that it will provide adequate and stable support for the object.

The slots provided in the interface, in conjunction with the supports, provide a selectively reconfigurable interface and support structure between a variety of vehicles such as various models of motorcycles, and the base. The bases may be provided in a variety of positions and orientations in the various slots of the interface. Depending upon the support and/or balance requirements of the object, the bases may be provided in the variety of positions to offer support of the object above a display floor. The selective adaptability and/or reconfigurability of the interface and/or the supports advantageously may reduce the number of parts required, while providing a "universal" display for use with a plurality of different vehicles and/or frame configurations (e.g. the plate and supports provide an interface for securing any of a variety of products or categories of objects that may have differing frame configurations or mounting points or may provide multiple mounting points or options for a single object or single type of objects).

Once the displayed product is positioned, member 84 may be attached to base 82. Member 84 may be configured to have a curved portion or finger portion (shown as portion 94) which wraps around, or on top of, the support structure of the object (e.g. a frame of a motorcycle). Member 84 may be attached to base 82 using a fastener 96 (shown as a bolt). When member 84 is installed, movement of the object relative to interface 40 is restrained. Member 84 may be provided with a slot 98. Once partially assembled, member 84 may be slid in a direction parallel with the slot 98, allowing member 84 to accept a variety of different sized structural members (e.g. frame configurations, mounting points, frame sizes). Supports 80 may be an adjustable support or clamp configured to accept a variety of sized structural members.

Slots 42 may be disposed in any desired location, along any desired axis, and any needed length to provide selective arrangement and placement of supports 80. Interface 40 is capable of receiving supports 80 at a variety of positions and locations. The supports may be configured and reconfigured as necessary. The ability to provide supports 80 in a variety of locations allows for a variety of objects to be supported and displayed on merchandising system 10. Additionally, a single object may be supported at a variety of different support positions. Providing a "universal" interface reduces construction costs, tooling costs, and design costs which could result if an individual display had to be constructed for a selected individual product configuration.

Indicia and/or instructions may be provided at or on the interface to specify or assist with the placement or position of the supports and may provide dimension and/or identification of a particular frame or product or vehicle, etc. (For example, see FIG. 4 with points marked as "A" to represent locations for supports for one object configuration.) Indicia may be representative of a desirable position or placement of the supports for one or more objects (compare indicia A with indicia B in FIG. 4). Additional indicia or sets of indicia may be added during assembly, added later during use, or adapted for a specific object or group of objects, as may be useful.

Figure 8:
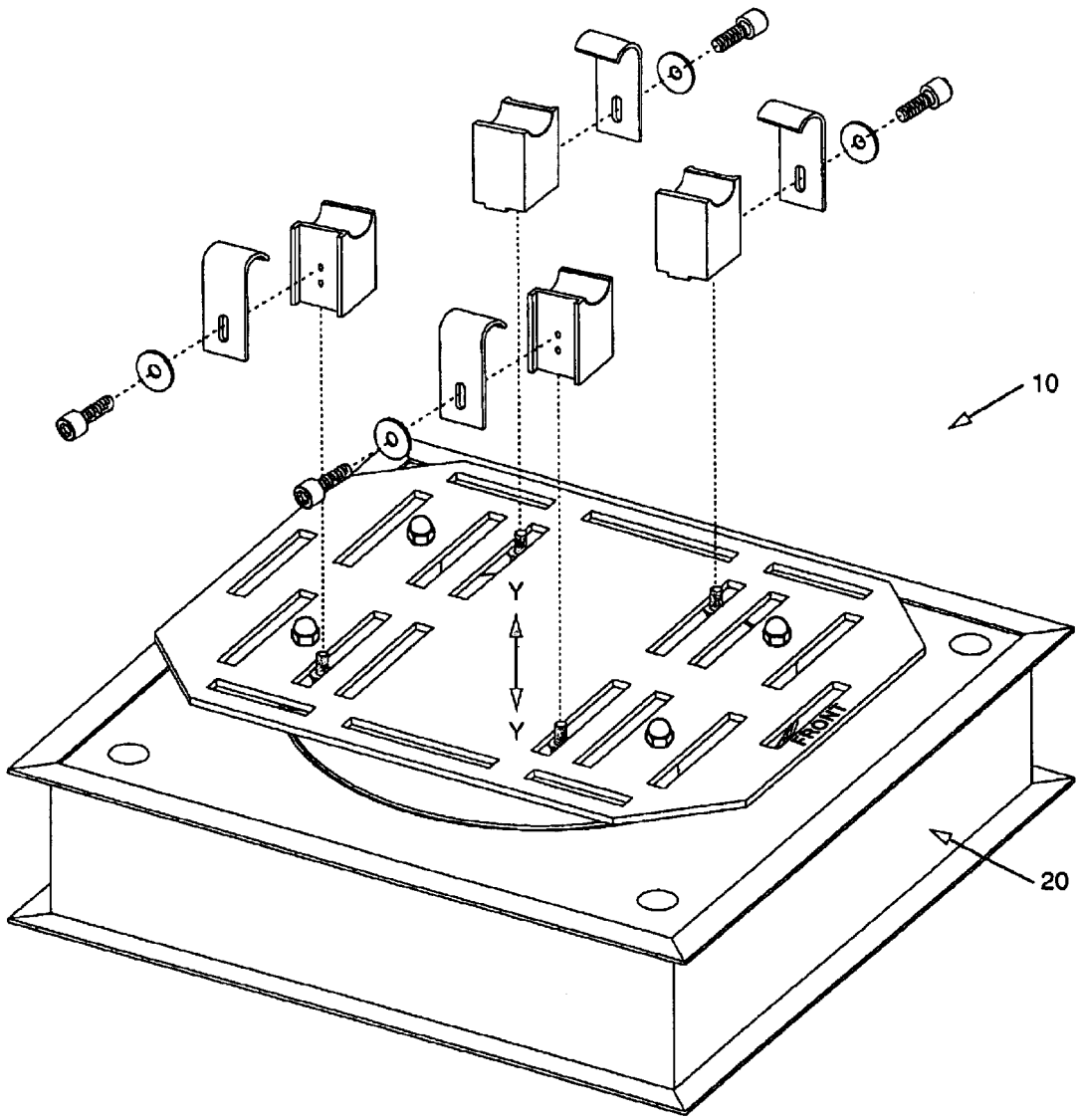
FIG. 8 is an exploded perspective view of the merchandising system shown in FIG. 1.

As shown in FIGS. 3 and 8, merchandising system 10 may further include connectors 100 (which may be tie-downs, web, webbing, straps, etc.). Connector 100 may include a fastening element or web (shown as web or strap 102), a hook 104, a retainer 106 and a fastener 108. Connector 100 may be provided to add additional stability to the object.

Web 102 may be attached to a suitable portion of the object (e.g. foot pegs, various locations of a frame, handle bars, etc.) (shown in FIG. 3 as member 196). Hook 104 may be used to secure web 102 to an attachment location on the object. Hook 104 may then be attached to interface 40 using a variety of fasteners including nuts, bolts, etc.

Web 102 may be a pliable or flexible material suitable to provide sufficient holding power when attached to the object. Web 102, according to a particularly preferred embodiment may be constructed from nylon webbing. Web 102 may further include apertures 110 (shown as a hole surrounded by a reinforcing washer) to be connected to hook 104.

Hook 104 may be attached to web 102 through apertures 110. Retainer 106 is provided for securing hook 104 to interface 40. According to a particularly preferred embodiment, retainer 106 is held in place on a bottom side of interface 40 with fastener 108 (shown as a nut). Fastener 108 attaches to a threaded portion on hook 104. As fastener 108 is tightened, hook 104 increases the holding force on web 102, thereby holding the object more firmly in place.

According to various exemplary embodiments, the components of the merchandising system may be made from a variety of materials which provide sufficient strength and rigidity to support and display the object. Such materials may include metals such as steel, steel alloys, aluminum, aluminum alloys, other various metals and alloys, composites, polymers, etc.

In an alternative embodiment, the interface may be provided in the form of an "open" frame or direct mounting to an adapter on the output shaft provided on the motor or the cover plate. In this alternative embodiment, the supports may be directly coupled to the motor or the cover plate. According to other alternative embodiments, the mounting structures may have other shapes and/or configurations. According to other alternative embodiments, the base may be a stationary (e.g. non-rotating) base such as a frame, bracket, shelf, or other support structure, or the interface may be installed upon a floor or wall or other "fixed" structure (e.g. without a "base").

It is also important to note that the construction and arrangement of the elements of the merchandising system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces (e.g. clamps, slots, plate, etc.) may be reversed or otherwise varied, the length or width of the structures and/or members, connectors, or other elements of the system may be varied, the nature or number of adjustment positions provided between the elements may be varied (e.g. by variations in the number of engagement slots or size of the engagement slots or type of engagement). It should be noted that the elements and/or assemblies of the system may be constructed from any of a wide variety of materials that provide sufficient strength or durability, in any of a wide variety of colors, textures and combinations. It should also be noted that the display system may be used in association with a rotating display, or alternatively other, fixed and non-movable displays or any of a wide variety of other surfaces in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A display system for differently sized vehicles, the display system comprising:

a base;

a first plate configured to be rotated relative to the base;

members coupled to the first plate;

a mounting plate comprising a number of slots and coupled to the members; and supports configured to be coupled to the mounting plate at locations along the slots;

wherein the supports are configured to be adjustable to accommodate differently sized vehicles.

2. The display system of claim 1 wherein the supports comprise clamps.

3. The display system of claim 1 further comprising a motor configured to rotate the first plate relative to the base.

4. The display system of claim 1 wherein an individual support further comprises a base; and a clamp portion coupled to the base;

wherein a portion of the vehicle is received between the base and the clamp portion.

5. The display system of claim 1 further comprising a hook adjustably coupled to the mounting plate; and a strap coupled to the hook;

wherein the strap is configured to couple with a portion of the vehicle.

6. A merchandising system for an object having a frame comprising:

a plate;

a number of apertures comprising a series of parallel slots provided in the plate;

a support received in one of the parallel slots and configured to couple with the plate;

wherein the support couples with the frame of the object, and the support is configured to be adjusted relative to the plate to accommodate objects of different size.

7. The merchandising system of claim 6 further comprising a base rotatably coupled to the plate.

8. The merchandising system of claim 6 wherein the support comprises a base; and a member;

wherein the frame of the object is received between the base and the member.

9. The merchandising system of claim 8 wherein the member is a clamp.

10. The merchandising system of claim 8 wherein the base and the member are configured to be adjustable relative to each other to accommodate frames of different size.

11. The merchandising system of claim 10 further comprising a slot provided on the member.

12. The merchandising system of claim 6 wherein the support comprises an adjustable clamp.

13. The merchandising system of claim 6 further comprising a hook adjustably coupled to the plate; and a strap coupled to the hook;

wherein the strap is configured to couple with a portion of the object.

14. The merchandising system of claim 13 further comprising a series of perpendicular slots to the parallel slots.

15. The merchandising system of claim 14 further comprising webbing configured to be coupled to the frame, and wherein the webbing is configured to couple to one of the perpendicular slots.

16. The merchandising system of claim 6 further comprising a cushioning material provided on the support.

* * * * *